US006446610B1

(12) United States Patent
Mazet

(10) Patent No.: US 6,446,610 B1
(45) Date of Patent: Sep. 10, 2002

(54) METHOD AND SYSTEM FOR CONTROLLING PRESSURE IN A HIGH PRESSURE FUEL PUMP SUPPLYING AN INTERNAL COMBUSTION ENGINE

(75) Inventor: Henri Mazet, Chatou (FR)

(73) Assignee: Magneti Marelli France, Nanterre (FR)

( * ) Notice: Subject to any disclaimer, the term of this patent is extended or adjusted under 35 U.S.C. 154(b) by 0 days.

(21) Appl. No.: 09/914,188

(22) PCT Filed: Feb. 24, 2000

(86) PCT No.: PCT/FR00/00459

§ 371 (c)(1),
(2), (4) Date: Oct. 29, 2001

(87) PCT Pub. No.: WO00/50757

PCT Pub. Date: Aug. 31, 2000

(30) Foreign Application Priority Data

Feb. 26, 1999 (FR) ..... 99 02424

(51) Int. Cl.[7] ..... F02M 37/04
(52) U.S. Cl. ..... 123/497; 123/357; 123/506
(58) Field of Search ..... 123/357, 506, 123/446, 497

(56) References Cited

U.S. PATENT DOCUMENTS

| | | | | | |
|---|---|---|---|---|---|
| 4,790,277 | A | * | 12/1988 | Schechter | 123/357 |
| 5,775,304 | A | * | 7/1998 | Kono et al. | 123/497 |
| 5,848,583 | A | * | 12/1998 | Smith et al. | 123/497 |
| 6,234,148 | B1 | * | 5/2001 | Hartke et al. | 123/447 |
| 6,308,685 | B1 | * | 10/2001 | Becker | 123/447 |
| 6,314,945 | B1 | * | 11/2001 | Sugiyma et al. | 123/506 |

* cited by examiner

*Primary Examiner*—Thomas N. Moulis
(74) *Attorney, Agent, or Firm*—Larson & Taylor PLC

(57) ABSTRACT

The control of the pressure in the high-pressure circuit (22) downstream from the pump (11) consists of controlling the solenoid valve (18) at the inlet of the pump (11) so that the fuel mass delivered by the pump (11) into the circuit (22) is equal to the algebraic sum of a fuel mass to be injected into the engine (1) and a fuel mass required to at least partially compensate a pressure difference between the fuel pressure measured by the sensor (4) in the circuit (22) and a target pressure desired by the control unit (5) in the circuit (22). Applies to pressure control for direct fuel injection into engines, particularly with externally supplied ignition.

9 Claims, 2 Drawing Sheets

Figure 1:
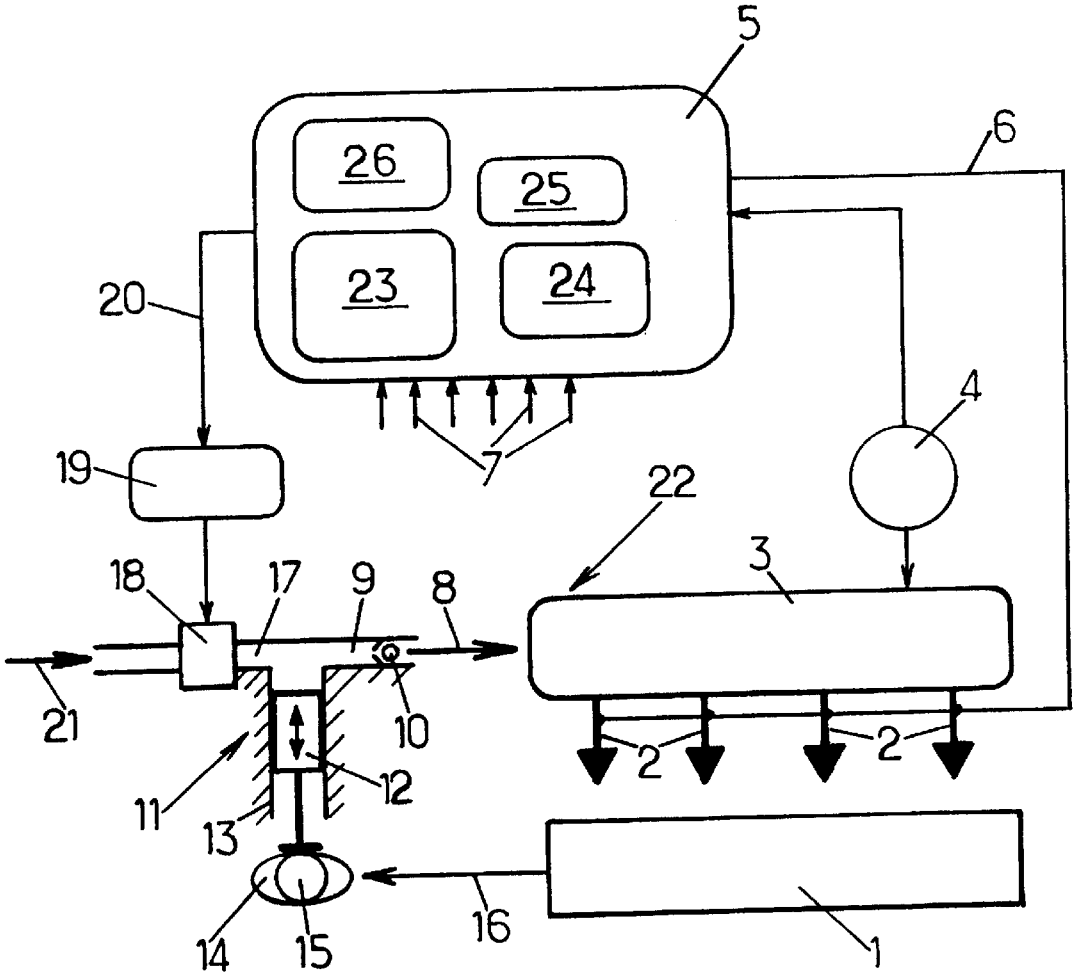

METHOD AND SYSTEM FOR CONTROLLING PRESSURE IN A HIGH PRESSURE FUEL PUMP SUPPLYING AN INTERNAL COMBUSTION ENGINE

The invention concerns a method and a system for controlling the pressure of a high-pressure fuel pump for feeding an internal combustion engine.

More precisely, the invention relates to the control of the pressure in a high-pressure fuel circuit for feeding, through at least one injector, an internal combustion engine, in particular with direct injection, especially with externally supplied ignition, but not excluding compression (diesel type) ignition.

In a system according to the invention, the internal combustion engine mechanically drives a high-pressure pump of the type with at least one reciprocating piston in a corresponding cylinder, the mechanical driving of the piston being for example being performed by a camshaft driven by the engine or belonging to the latter, and the high-pressure pump discharging into the high-pressure circuit, which is the type without a continuous return of the fuel from the downstream end to the upstream end of the pump, the fuel pressure in the high-pressure circuit being measured by at least one pressure sensor, and the pump being equipped, for each piston, with an on-off solenoid valve for controlling the fuel supply of the corresponding pump cylinder.

In known systems of this type, which pressurize the fuel using a high-pressure pump mechanically driven by the internal combustion engine fed by the pump, wherein the quantity of fuel delivered per pump cycle for each piston is controlled by an on-off solenoid inlet valve, which determines the volumetric efficiency of the pump by controlling the circuit that supplies fuel to the pump, it is known to try to establish, in the high-pressure circuit between the pump and the engine, a fuel pressure equal to a target pressure, determined as a function of operating parameters and/or conditions of the internal combustion engine, by performing a direct control, acting directly on the quantity of fuel delivered by the pump so as to increase, or respectively decrease, this quantity per pump cycle depending on whether the fuel pressure measured in the high-pressure circuit by the pressure sensor is lower than, or respectively higher than, the target pressure.

The drawback of these known pressurization systems is that they provide a simplified control that does not take into account the operating modes of the various components of the system, and in particular the high-pressure fuel circuits.

The basic problem of the invention is to eliminate this drawback and to offer a pressure control method and system that provides more precise control by establishing a fuel pressure approximately equal to a target pressure by acting on a control parameter that is not directly linked to the quantity to be controlled, i.e., the fuel pressure in the high-pressure circuit, the control parameter in this case being the control sequence of the solenoid valve at the inlet of each cylinder of the high-pressure pump.

To this end, the pressure control method according to the invention of the above-mentioned type is characterized in that it includes the step that consists of controlling the fuel pressure by driving the solenoid valve so that the fuel mass delivered by said pump into said high-pressure circuit is equal to the algebraic sum of a fuel mass to be injected into the internal combustion engine (and known by an engine control unit that controls at least the fuel injection into the engine), and of a required fuel mass, or a quantity determined from said required mass, for at least partially correcting the pressure difference between the fuel pressure measured in the high-pressure circuit by means of said pressure sensor and a target pressure desired in said high-pressure circuit.

Thus, the fuel pressure in the high-pressure circuit is controlled, particularly for direct injection, by using a solenoid valve to control the supply of fuel to the high-pressure pump, this solenoid valve making it possible to adjust the quantity of fuel delivered by the pump in the high-pressure circuit, and thus to adjust the fuel pressure in the circuit so as to bring it in line with the target pressure.

Advantageously, said required fuel mass for at least partially correcting the difference between the measured and target pressures is determined by means of at least one relation between the mass or mass variation of the fuel, and the pressure or pressure variation of the fuel in said high-pressure circuit, so as to take into account the operating mode of the high-pressure circuit, and in particular its behavior and that of the fuel that the circuit contains under the operating conditions of the circuit, considering the quantities of fuel delivered by the pump into this circuit.

Advantageously, this relation between the mass or mass variation and the pressure or pressure variation of the fuel in the high-pressure circuit is determined by taking into account at least one of the operating parameters, such as the measured pressure and the temperature of the fuel, and/or the compressibility law of the fuel used, and/or at least one of the geometric parameters of the high-pressure circuit, and/or at least one of the mechanical and/or physical properties of the materials of the elements constituting said high-pressure circuit.

In order to adapt the quality of the control in terms of speed, stability and precision, the control method advantageously also includes a step that consists of weighting the required fuel mass for correcting the difference between the measured and target pressures with a correction of the proportional-integral-derived type, this correction being performed for example by an algorithm of a well-known type.

After having calculated the fuel mass that the pump should deliver, the method of the invention also provides for a determination of the moments of operation of the solenoid valve, taking into account the operation of the pump and the operation of the solenoid valve. For this purpose, as concerns the operation of the pump, the method of the invention advantageously also includes a step that consists of controlling the solenoid valve, taking into account at least one relation between the delivery rate of the pump and the angular position of the engine, which mechanically drives it, during the closed periods of said solenoid valve. More generally, the method of the invention takes into account a relation that indicates the quantity of fuel delivered by the pump to the high-pressure circuit as a function of the sequencing of the opening and closing of the solenoid valve located in the supply circuit of said pump.

For better precision, this relation expressing the delivery rate of the pump advantageously takes into account at least one operating parameter such as the fuel pressure, the rotation speed and/or the operating temperature of the pump.

As concerns the behavior of the solenoid valve, the method of the invention advantageously also includes a step consisting of controlling said solenoid valve, taking into account at least one relation between the delay in the actual openings and closings of the solenoid valve relative to the electrical commands for controlling the opening and the closing, and also at least one of the operating parameters and conditions of said solenoid valve, and preferably at least one parameter related to the fuel.

Preferably, in order to obtain good precision, this relation related to the delay of the solenoid valve takes into account at least one of the parameters that include the supply voltage and the operating temperature of the solenoid valve, as well as the difference in fuel pressure between the inlet and the outlet of said solenoid valve.

The invention also relates to a system for controlling the pressure in a high-pressure fuel circuit for feeding, through at least one injector, an internal combustion engine, in particular with direct injection, and especially with externally supplied ignition, a system wherein said engine mechanically drives a high-pressure pump of the type with at least one reciprocating piston in a corresponding cylinder, said pump discharging into said high-pressure circuit, which is the type without a continuous return of the fuel from the downstream end to the upstream end of said pump, and wherein the fuel pressure is measured by at least one pressure sensor of the system, said pump being equipped, for each piston, with an on-off solenoid valve for controlling the fuel supply of the corresponding pump cylinder, and according to the invention, this system is characterized in that it includes at least one electronic pressure control unit, in connection with or integrated into an electronic engine control unit, which controls the injection and, if necessary, the ignition of the engine, and determines, in particular, the fuel mass to be injected into the engine, said electronic pressure control unit [operating the solenoid valve in order to control the feeding of said cylinder of the pump and] including computing means and storage means and being equipped to implement the method according to the invention as defined above, and the electronic pressure control unit comprising at least one module for determining the relation, possibly weighted, between the mass or mass variation and respectively the pressure or pressure variation of the fuel in the high-pressure circuit, at least one module for determining the target pressure desired in said high-pressure circuit as a function of operating parameters and/or conditions of the engine, at least one module for determining the fuel mass to be delivered by the pump into the high-pressure circuit, as a function of a signal of the fuel mass to be injected into the engine and received by the engine control unit, and of the fuel mass for compensating the pressure difference between the pressure measured by the pressure sensor and the target pressure, at least one module for determining the delay of said solenoid valve, and at least one module for determining the delivery rate of the pump as a function of the angular position of the engine and of the sequencing of the opening and closing of said solenoid valve.

Other characteristics and advantages of the invention will emerge from the description given below, as an illustration of a non-limiting exemplary embodiment described in reference to the attached drawings, in which:

FIG. 1 is a diagram of the pressure control system of the invention installed in the fuel supply circuit of an internal combustion engine of an automobile, and FIG. 2 represents superposed timing charts representing an operating model of the high-pressure pump, as a function of the angular position of the internal combustion engine and of the sequencing of the opening and closing of the solenoid valve, for determining the quantity of fuel delivered by the pump to the high-pressure circuit.

FIG. 1 schematically represents in 1 an internal combustion engine of an automobile, for example a four-stroke engine with four in-line cylinders, externally supplied ignition and direct fuel-injection.

This direct fuel injection is provided in each cylinder of the engine 1, respectively by one of the four injectors schematically represented in 2, all of which are supplied with high-pressure fuel through a common fuel rail 3, wherein the high fuel pressure is measured by a pressure sensor 4 that transmits the measured pressure signal to an electronic control unit 5. This unit 5 is simultaneously an engine control unit that controls the ignition in the cylinders of the engine 1 and, through the line 6, the times and durations of the opening of the solenoid injectors 2, in order to control the quantity of fuel injected by each of the injectors 2 into each of the corresponding cylinders of the engine 1, as a function of the power cycle in each of the cylinders, the operating parameters and conditions of the engine, particularly its speed, its load, its temperature, etc., and the fuel quantity demand, particularly as a function of the air intake into the engine 1, the design of the unit 5 for this purpose not being further described in the present if specification, since it is well known. The operating parameters of the engine are entered into the unit 5 through the inputs schematically represented in 7.

The fuel rail 3 is supplied with fuel through a conduit schematically represented in 8 at the outlet 9, in which is installed a non-return valve schematically represented in 10, by a single-piston pump 11 wherein the piston 12 is driven in a reciprocating movement inside a cylinder 13 by a rotating cam 14 with a camshaft 15, itself mechanically driven in rotation by the engine 1 via a linkage schematically represented in 16, which can be a belt linkage between a pulley that rotates along with the camshaft 15 and another pulley driven in rotation by the crankshaft of the engine 1.

The pumping chamber, essentially delimited by the piston 12 in the cylinder 13 of the pump 11, thus mechanically driven by the engine 1, is also connected to an inlet 17, in which is installed a solenoid valve 18, whose on-off operation is controlled by its electric control stage 19, which conventionally comprises a solenoid and is itself controlled by the unit 5 through the line 20.

The solenoid valve 18 for controlling the supply of fuel to the pump 11 is itself supplied with low-pressure fuel by an upstream low-pressure circuit with a conventional structure (not represented), which includes a fuel reservoir from which fuel is drawn by a low-pressure pump and transmitted, through a filter and a conduit schematically represented by the arrow 21, to the solenoid valve 18.

The fuel delivery system 1 of the engine 1 thus comprises a low-pressure circuit (not represented) upstream from the solenoid valve 18, and a high-pressure circuit downstream from the non-return valve 10 in the outlet 9 of the pump 11, this high-pressure circuit essentially comprising the fuel rail 3 and the connecting conduit 8 between the outlet 9 of the pump 11 and this rail 3.

In a variant, the rail 3 can be equipped with a pressure relief valve, connected to the conduit 21 upstream from the solenoid valve 18, for discharging the rail 3 when the fuel pressure in this rail 3 exceeds a critical threshold. But the high-pressure circuit 22 is also a circuit without a continuous return or recirculation of the fuel to the upstream end of the high-pressure pump 11 and the solenoid inlet valve 18.

This solenoid valve 18 for controlling the supply of fuel to the pump 11 can be a solenoid valve that is normally closed, and held closed by the force of the pressure inside the pump 11 and by an internal spring (not represented) of the solenoid valve 18, which is only opened when its electric control stage 19 receives an electronic opening command from the unit 5.

This unit 5, according to the invention, is also a pressure control unit that makes it possible to control the pressure of the fuel in the high-pressure circuit 22, downstream from the single-piston pump 11, by adjusting the quantity of gasoline delivered by this pump 11, and hence its pressure in the high-pressure circuit, through the control of the sequencing of the opening and closing of the solenoid valve 18 by the unit 5.

This pressure control in the high-pressure circuit 22 is obtained in the following way.

The control unit 5 determines a target pressure Po desired in the high-pressure circuit 22, as a function of operating parameters of the engine 1 such as the speed and the load of the engine and its temperature, which are transmitted from appropriate sensors to the unit 5 through the inputs 7. This determination of the target pressure Po is obtained, for example, through the implementation in the unit 5 of an algorithm that takes into account these operating parameters of the engine 1. The unit 5 determines the target fuel pressure Po, and knows at all times, by means of the pressure sensor 4, the measured fuel pressure Pm in the high-pressure circuit 22, and hence the unit 5 can deduce the pressure difference ΔP between the measured pressure Pm and the target pressure Po. The pressure control controlled by the unit 5 consists of controlling the sequencing of the opening and closing of the solenoid valve 18, via the line 20 and the electric control stage 19 of this solenoid valve 18, so that the pump 11 delivers into the high-pressure circuit enough of a fuel mass to compensate the pressure difference ΔP, in addition to the fuel mass that will be transmitted by injection from the rail 3 to the engine 1 by the injectors 2. This fuel mass Qm to be consumed by the engine 1, i.e. the mass issuing from the rail 3, is known by the unit 5, wherein the part forming the engine control unit has the specific task of determining this quantity Qm of fuel consumed by the engine 1. If we let QΔP be the fuel mass that must be delivered by the pump 11 into the high-pressure circuit 22 in order to compensate the pressure difference ΔP, it is understood that the fuel mass Qp delivered by the pump 11 to the high-pressure circuit is given by the formula (1):

$$Qp=Qm+Q\Delta p \quad (1)$$

The control of the solenoid valve 18 by the control unit 5 is therefore provided so as to correct the error between the fuel pressure Pm measured in the rail 3 by the sensor 4 and the target pressure Po determined by the unit 5, by acting on the fuel mass present inside the high-pressure circuit 22. Thus, before each operation of the solenoid valve 18, the unit 5 determines, by computation and by map reading as explained below, the fuel mass that the pump 11 must supply as being the algebraic sum of the fuel mass Qm that must leave the high-pressure circuit 22, i.e. the quantity of fuel to be injected into the engine 1 by the injectors 2, and the mass variation QΔP required to compensate the pressure error ΔP, taking into account the behavior of the high-pressure circuit 22 as a container, and the quantity of fuel it contains as content, under the effect of the pressurization.

For this purpose, the control unit 5, in addition to the module 23 that it contains for determining the target pressure and comparing it to the measured pressure in order to determine the pressure difference ΔP, includes another module 24 that determines a "strength" or "rigidity" model of the high-pressure circuit 22. This module 24 determines a relation that expresses the mass or mass variation of the fuel contained in the high-pressure circuit 22 as a function of the pressure or of a pressure difference in the circuit 22, taking into account the geometry of this circuit 22, i.e. the geometry of the conduit 8 and the rail 3, as well as the mechanical and physical properties, particularly the modulus of elasticity E, of the materials constituting this conduit 8 and this rail 3, in order to take into account the fact that the internal volume of the high-pressure circuit 22 increases substantially under the effect of the high fuel pressure inside this circuit 22. Moreover, this relation between fuel mass and fuel pressure in the circuit 22, or between mass variation and pressure variation, takes into account the behavior of the fuel, particularly its compressibility law, as a function of the operating conditions, such as the temperature of the fuel and the measured pressure Pm of the fuel in the circuit 22.

The module 24 therefore determines a strength or rigidity coefficient K, calibrated and read in map tables drawn up taking into account the geometric parameters, the physical and mechanical properties, and the aforementioned operating conditions, this strength coefficient K approximately corresponding to the slope of a characteristic curve that expresses a fuel mass variation in the high-pressure circuit as a function of a pressure variation in this circuit.

Knowing the strength coefficient K determined by the module 24 and knowing the pressure difference ΔP between the measured pressure Pm and the target pressure Po, using the module 23, the control unit 5 can calculate the fuel mass QΔP to be delivered into the high-pressure circuit 22 in order to compensate the pressure difference ΔP, using the formula (2):

$$Q\Delta P=K\times(Pm-Po) \quad (2)$$

so that the fuel mass to be delivered by the pump 11 in each pump cycle of its piston 12, taking into account the formula (1), is given by the formula (3):

$$Qp=Qm+K\times(Pm-Po) \quad (3)$$

However, in order to adapt the quality of the pressure control in terms of speed, precision and stability, the process implemented by the control unit 5 takes into account not only the exact fuel mass QΔP required to compensate the pressure difference ΔP, but a value calculated from this exact mass and equal to a percentage that is less than or equal to 100% of this exact mass, for example using an algorithm of the proportional-integral-derived type to make a corresponding correction.

The proportional term of this correction takes into account a proportion of this exact mass that only corresponds to a proportion of the pressure difference, while the derived term takes into account the direction of the change, i.e. increasing or decreasing, of this pressure difference, and the integral term integrates consecutive slight variations over time in order to deduce a trend in the change. Such algorithms of the PID (Proportional-Integral-Derived) type are well known to one skilled in the art and are therefore not explained further in the present specification.

After having calculated the fuel mass that the pump 11 must deliver into the high-pressure circuit 22, the control unit 5 determines the times at which to command the solenoid valve 18 to open or close, based on a functional model of the pump 11 implemented in the module 25 of the unit 5, and on a functional model of the solenoid valve 18 implemented in a module 26 of the unit 5.

The functional model of the pump 11 implemented in the module 25 determines a delivery curve for the fuel delivered by the pump 11 into the high-pressure circuit 22 as a function of the sequencing of the opening and closing of the solenoid valve 18 in the supply circuit of the pump 11, and taking into account the angular position of the engine 1, i.e. the angular position of its rotating element, for example its crankshaft, which mechanically drives the cam 14 shaft 15 for driving the piston 12 of the pump 11, and hence determines the angular position of the cam 14, and thus the intake and delivery phases of the pump 11.

Figure 2A:
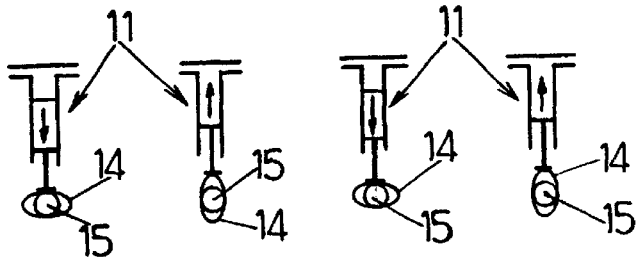

This functional model of the pump 11 is described in reference to FIG. 2, in which the diagrams of FIG. 2*a*) represent, in succession from left to right, the piston 12 of the pump 11 at the bottom dead center, at the end of an intake phase, then the piston 12 at the top dead center, at the end of the consecutive delivery or compression phase, then the piston 12 at the next bottom dead center, and lastly at the next top dead center. The curve of FIG. 2*b* represents the stroke X of the piston 12 in the cylinder 13 as a function of the angle a of rotation of the crankshaft of the engine 1, and hence also of the cam 14 shaft 15 that drives the pump 11, and this curve represents the successive movements to the bottom dead centers BDC and top dead centers TDC of the piston 12, a delivery phase taking place between a BDC and the following TDC, while an intake phase takes place between a TDC and the following BDC.

Figure 2B:
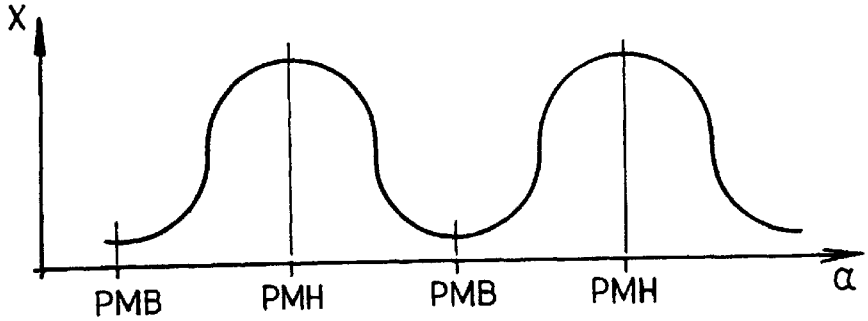
Figure 2C:
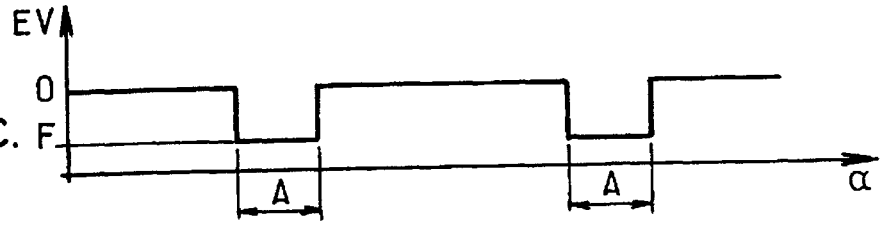
Figure 2D:
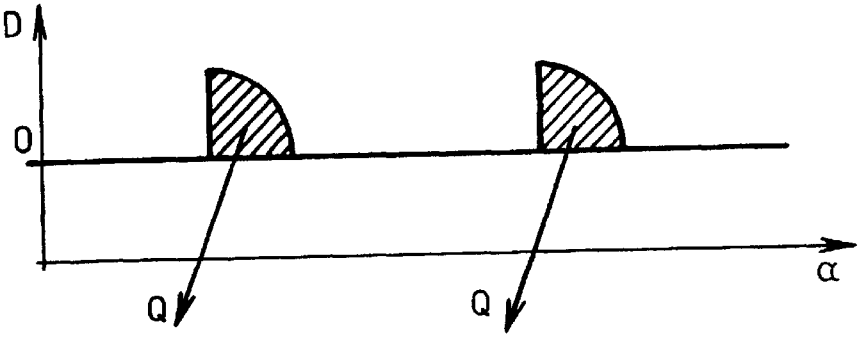
Figure 2E:
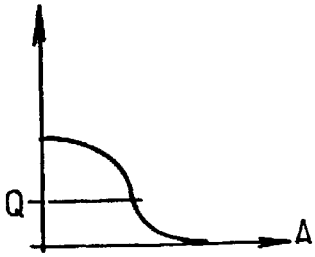

The curve of FIG. 2*c*) represents the successive closed F and open O states of the on-off solenoid valve EV 18, as a function of the angle a indicated above, and comparing the curves of FIGS. 2*b*) and 2*c*) makes it possible to see that the closures of the solenoid valve 18 during the delivery phases of the pump 11 produce an instantaneous delivery D of a quantity of fuel from the pump 11 into the high-pressure circuit 22 as indicated in FIG. 2*d*) during the angular strokes A (see FIG. 2*c*) corresponding to the closures of the solenoid valve 18. The result is a transferred fuel mass Q, which corresponds to the integration of the instantaneous delivery curve D, i.e. to the hatched area delimited by this curve D, the change in this mass Q delivered as a function of the angular closed area A being indicated in FIG. 2*e*). These values of Q as a function of the values of A and of a are also calibrated and stored in maps, drawn up taking into account the parameters mentioned below.

The functional model of the pump 11, as implemented by the module 25 of the unit 5, takes into account not only the geometric characteristics of the pump 11 but also its operating conditions, such as the temperature and the rotation speed of the pump 11, as well as the fuel pressure, particularly at the downstream end of he pump 11, i.e., in the high-pressure circuit, but also at the upstream end of the pump 11 when the solenoid valve 18 is open.

The control unit 5 also includes a module 26 that implements an operational model of the solenoid valve 18 and of its electric control stage 19, this model determining the delay between the electric closing and opening commands from the control stage 19 and the actual opening and closing of the hydraulic circuit by the solenoid valve 18. This model of the solenoid valve 18 takes into account the specific properties of this solenoid valve 18 as well as the operating conditions, such as the supply voltage of its electric control stage 19, its temperature, and parameters linked to the fuel, particularly the difference in pressure between the inlet and the outlet of the solenoid valve 18. These various operating parameters and conditions are calibrated and stored in maps, the reading of which makes it possible to obtain actual times for the electrical operation of the solenoid valve 18 from target opening or closing times of the hydraulic circuit by the solenoid valve 18, taking into account the model indicating the delay of the solenoid valve 19.

The various modules 23 through 26 of the control unit 5 thus comprise computing means, and means for storage in tables or maps, that are well known and that do not need to be described further.

In the control described above, fuel leaks outside the high-pressure circuit have not been taken into account, but this can be done by modeling these leaks, which can also be calibrated and mapped. Moreover, cavitation phenomena at the closing of the solenoid valve 18 have not been taken into account, nor have the pressure fluctuations of various origins (excitation of the injectors 2, of the piston 12 and the response of the circuit 22) that can occur in the high-pressure circuit 22; only the average measured and target pressures have been considered, in a rail 3 considered to be always full of fuel.

What is claimed is:

1. Method for controlling the pressure in a high-pressure fuel circuit (22) for feeding, through at least one injector (2), an internal combustion engine (1), in particular with direct injection, and especially with externally supplied ignition, that mechanically drives a high-pressure pump (11) of the type with at least one reciprocating piston (12) in a corresponding cylinder (13) that discharges into said high-pressure circuit (22), which is the type without a continuous return of the fuel from the downstream end to the upstream end of said pump (11), and wherein the fuel pressure is measured by at least one pressure sensor (4), said pump (11) being equipped, for each piston (12), with an on-off solenoid valve (18) for controlling the fuel supply of said corresponding pump cylinder (13), characterized in that it includes the step that consists of controlling the fuel pressure by operating said solenoid valve (18) so that the fuel mass delivered by said pump (11) into said high-pressure circuit (22) is equal to the algebraic sum of a fuel mass to be injected into said engine (1) and of a required fuel mass, or a quantity determined from said required mass, for at least partially correcting the pressure difference between the fuel pressure measured in the high-pressure circuit (22) by means of said pressure sensor (4) and a target pressure desired in said high-pressure circuit (22).

2. Method according to claim 1, characterized in that it includes the step that consists of determining said required fuel mass for at least partially correcting the difference between the measured and target pressured by means of at least one relation between the fuel mass or fuel mass variation and the fuel pressure or fuel pressure variation in said high-pressure circuit (22).

3. Method according to claim 2, characterized in that it includes the step that consists of determining said relation between the fuel mass or fuel mass variation and the fuel pressure or fuel pressure variation in the high-pressure circuit (22), taking into account at least one of the operating parameters, such as the measured pressure and the temperature of the fuel, and/or the compressibility law of the fuel, and/or at least one of the geometric parameters of the high-pressure circuit (22) and/or at least one of the mechanical and/or physical properties of the materials of the elements (8, 3) constituting said high-pressure circuit (22).

4. Method according to claim 1, characterized in that it also comprises the step consisting of weighting said required fuel mass for correcting said difference between the measured and target pressures with a correction of the proportional-integral-derived type.

5. Method according to claim 1, characterized in that it also comprises the step that consists of controlling said solenoid valve (18), taking into account at least one relation between the delivery quantity of the pump (11) and the angular position of the engine (1) during the closed periods of this solenoid valve (18).

6. Method according to claim 5, characterized in that said relation expressing the delivery quantity of the pump (11) takes into account at least one operating parameter such as the fuel pressure, the rotation speed and/or the operating temperature of the pump (11).

7. Method according to claim 1, characterized in that it also comprises a step that consists of controlling said solenoid valve (18), taking into account at least one relation between the delay of the actual openings and closings of the solenoid valve (18) relative to the electric commands for controlling the opening and the closing, and at least one of the operating parameters and conditions of said solenoid valve (18).

8. Method according to claim 7, characterized in that said relation relative to the delay of the solenoid valve (18) takes into account at least one of the parameters that include the supply voltage and the operating temperature of the solenoid valve (18) and the difference in fuel pressure between the inlet and the outlet of said solenoid valve (18).

9. System for controlling the pressure in a high-pressure fuel circuit (33) for feeding, through at least one injector (2), an internal combustion engine (1), in particular with direct injection, and especially with externally supplied ignition, wherein said engine (1) mechanically drives (14, 15, 16) a high-pressure pump (11), of the type with at least one reciprocal piston (12) in a corresponding cylinder (13), said pump (11) discharging into said high-pressure circuit (22), which is the type without a continuous return of the fuel from the downstream end to the upstream end of said pump (11), and wherein the fuel pressure is measured by at least one pressure sensor (4) of the system, said pump (11) being equipped, for each piston (12), with an on-off solenoid valve (18) for controlling the fuel supply of the corresponding pump cylinder (13), characterized in that it includes at least one electronic pressure control unit (5), in connection with or integrated into an electronic engine control unit, which controls the injection and, if necessary, the ignition of the engine (1), and determines, in particular, the fuel mass to be injected into the engine (1), said electronic pressure control unit (5) including computing means and storage means and being equipped to implement the method according to claim 1, and comprising at least one module (24) for determining the relation, possibly weighted, between the mass or mass variation and respectively the pressure or pressure variation of the fuel in the high-pressure circuit (22), at least one module (23) for determining the target pressure desired in said high-pressure circuit (22) as a function of operating parameters and/or conditions of the engine (1), at least one module for determining the fuel mass to be delivered by the pump (11) into the high-pressure circuit (22), as a function of a signal of the fuel mass to be injected into the engine (1) and received by the engine control unit, and of the fuel mass for compensating the pressure difference between the pressure measured by the pressure sensor (4) and the target pressure, at least one module (26) for determining the delay of said solenoid valve (18), and at least one module (25) for determining the delivery rate of the pump (11) as a function of the angular position of the engine (1) and of the sequencing of the opening and closing of said solenoid valve (18).

* * * * *